United States Patent [19]

Sato et al.

[11] 4,028,112

[45] June 7, 1977

[54] PHOTOGRAPHIC SENSITIVE MATERIALS HAVING A DYED LAYER

[75] Inventors: Akira Sato; Tadashi Ikeda; Tohru Sueyoshi; Yasuharu Nakamura; Takeo Shimada, all of Minami-ashigara, Japan

[73] Assignee: Fuji Photo Film Co., Ltd., Minami-ashigara, Japan

[22] Filed: May 9, 1975

[21] Appl. No.: 575,878

[30] Foreign Application Priority Data

May 10, 1974 Japan ..... 49-51927

[52] U.S. Cl. ..... 96/84 R

[51] Int. Cl.[2] ..... G03C 1/84

[58] Field of Search ..... 96/84 R

[56] References Cited

UNITED STATES PATENTS

| | | | |
|---|---|---|---|
| 2,527,583 | 10/1950 | Silberstein et al. | 96/84 R |
| 3,016,306 | 1/1962 | Mader et al. | 96/84 R |
| 3,282,699 | 11/1966 | Jones et al. | 96/84 R |
| 3,877,945 | 4/1975 | Rosenhahn et al. | 96/84 R |

*Primary Examiner*—Jack P. Brammer

*Attorney, Agent, or Firm*—Sughrue, Rothwell, Mion, Zinn & Macpeak

[57] ABSTRACT

A silver halide photographic sensitive material containing a dye comprising at least one merocyanine dye having at least two acid groups in which the basic nucleus is an oxazole nucleus and at least one of the 4- and 5-positions of the oxazole nucleus is substituted with an aryl group or a substituted aryl group in at least one hydrophilic colloid layer of the silver halide photograhic sensitive material, and a basic polymer in at least one hydrophilic colloid layer of the silver halide photographic sensitive material.

6 Claims, No Drawings

PHOTOGRAPHIC SENSITIVE MATERIALS HAVING A DYED LAYER

BACKGROUND OF THE INVENTION

1. Field of the Invention

The present invention relates to silver halide photographic sensitive materials having a dyed hydrophilic colloid layer. Particularly, the present invention relates to silver halide photographic sensitive materials wherein a dye and a basic polymer are included in at least one hydrophilic colloid layer respectively.

2. Description of the Prior Art

In silver halide photographic sensitive materials, a photographic emulsion layer or another hydrophilic colloid layer is often dyed so that light having a specified wavelength range is absorbed thereby.

When the spectral composition of light contacting a photographic emulsion layer needs to be controlled, a dyed layer is usually provided at a position farther away from the support than the photographic emulsion layer. Such a dyed layer is called a filter layer. In the case of multilayer color photosensitive materials having a plurality of photographic emulsion layers, the filter layer is sometimes positioned between photographic emulsion layers.

In the case of preventing a blurring of images, namely, halation caused by the fact that light scattered on passing through the photographic emulsion layer or after transmission is reflected at an interface between the emulsion layer and the support or a surface of the photosensitive material opposite the emulsion layer and is introduced again into the photographic emulsion layer, a dyed layer is usually provided between the photographic emulsion layer and the support or on a surface of the support opposite the photographic emulsion layer. Such a dyed layer is called an antihalation layer. In the case of a plurality of photographic emulsion layers such as exists in multilayer color photosensitive materials, the antihalation layer is sometimes positioned between photographic emulsion layers.

In order to prevent a deterioration of the sharpness of images caused by a scattering of light in a photographic emulsion layer (this phenomenon is called irradiation), the photographic emulsion layer is sometimes dyed, too.

Generally, a water-soluble dye is added to the hydrophilic colloid layer to be dyed. The dye used for such a purpose should have not only an appropriate spectral absorption according to the purpose of use but also the following properties.

1. The dye should be photographically chemically inactive. Namely, the dye should not have an adverse chemical influence upon the properties of the silver halide photographic emulsion layers, for example, reduction of sensitivity, deterioration of latent images or fog, etc.

2. The dye should be decolored during photographic processings or the dye should dissolve in the processing solutions or water used for rinsing and should not result in a coloration of the photographic sensitive materials after processing.

In order to discover dyes which satisfy these requirements, much effort has been expended by persons skilled in the art. For example, oxonol dyes having a pyrazolone nucleus represented by the dyes described in British Pat. No. 506,385, oxonol dyes having a barbituric acid nucleus represented by the dyes described in U.S. Pat. No 3,247,127, oxonol dyes described in U.S. Pat. Nos. 2,533,472 and 3,379,533 and British Pat. No. 1,278,621, hemioxonol dyes represented by the dyes described in British Pat. No. 584,609, styryl dyes represented by the dyes described in U.S. Pat. No. 2,298,733, merocyanine dyes represented by the dyes described in U.S. Pat. No. 2,493,747 and cyanine dyes represented by the dyes described in U.S. Pat. No. 2,843,486 are known.

Many of the dyes which are decolored during processing of the photographic emulsion can be decolored by sulfites (or bisulfites) included in development processing solutions or by sulfites under alkaline conditions, for example, as described in British Pat. No. 506,385.

Where the dyed layer is a filter layer or where the dyed layer is an antihalation layer positioned on the support and on the same side of the support as the photographic emulsion layer(s), such a layer often needs to be selectively dyed while other layers should not substantially be affected. If such a requirement is not satisfied, the dye not only produces a harmful spectral effect upon other layers but also the dye also deteriorates the effect as the filter layer or as the antihalation layer.

In order to selectively dye a specified hydrophilic colloid layer, many processes are known. However, a process which comprises incorporating a hydrophilic polymer having a charge of the opposite polarity to a dye ion as a mordanting agent in the hydrophilic colloid layer whereby the dye is present in the specified layer due to a mutual interaction between the dye molecule and the hydrophilic polymer is most commonly used (it is supposed that not only an attraction due to the charges but also a hydrophobic bond contributes thereto). As the mordanting agent, there are polymers derived from ethylenically unsaturated compounds having a dialkylaminoalkyl ester group as described in British Pat. No. 685,475, reaction products prepared by reacting a polyvinylalkylketone with aminoguanidine as described in British Pat. No. 850,281 and polymers derived from 2-methyl-1-vinyl-imidazole as described in U.S. Pat. No. 3,445,231. Where a process involving mordanting by such polymers is used, if the layer containing the dye is contacted with another hydrophilic colloid layer in a wet state, a portion of the dye often diffuses from the dye layer to the other colloid layer. Such a diffusion of the dye depends not only on the chemical structure of the mordanting agent but also on the chemical structure of the dye used.

Where the above-described high molecular weight mordanting agent is used, a residual color in the photosensitive material easily results after photographic processings and particularly after the photographic processing wherein the period of processing time is shortened. The reason for this is believed to be that the dye or a reversible released product remains in the layer containing the mordanting agent because some bonding strength of the dye to the mordanting agent remains even though the bonding strength becomes considerably weakened in alkaline solutions such as a developer. Although such difficulty depends on the chemical structure of the mordanting agent, to a great extent, it depends on the chemical structure of the dye too.

Of the various water-soluble dyes used for dyeing the hydrophilic colloid layer of photographic sensitive materials, merocyanine dyes having an oxazole nucleus have been used as preferred dyes, because they are irreversibly decolored in a developer containing sulfites and hardly have any adverse influence on the photographic properties of the photographic emulsion. However, merocyanine dyes wherein the oxazole nucleus is not substituted or wherein the 4- and 5-positions of the nucleus are substituted with lower alkyl groups or cyano groups are not sufficiently mordanted by the above-described basic polymers resulting in a diffusion of the dyes from the layer containing the basic polymer to other layers, even though acid groups such as sulfo groups are introduced into the dyes.

On the other hand, where the dyed layer functions as a filter layer, it is necessary for the absorption density to be above about 0.8 and such a density often must be obtained witha layer thickness of 2 $\mu$m or less. For example, a typical case is a yellow filter layer which is positioned below a blue sensitive layer in a multilayer color photosensitive material. In such a case, the dye must dissolve in the hydrophilic colloid at a high concentration. Merocyanine dyes having an oxazole nucleus which have only one acid group as a water-solubilizing group are not sufficient at all for the above described purpose, because they have a low later solubility and a poor compatibility with the hydrophilic colloid layer.

SUMMARY OF THE INVENTION

A first object of the present invention is to provide photographic sensitive materials having a hydrophilic colloid layer which contains a water-soluble dye which can be irreversibly decolored during photographic processings and does not adversely influence the photographic properties of photographic emulsions at a high concentration.

A second object of the present invention is to provide silver halide photographic sensitive materials wherein only a hydrophilic colloid layer containing a basic polymer is sufficiently and selectively dyed.

A third object of the present invention is to provide photographic sensitive materials which comprise a hydrophilic colloid layer containing a dye which does not result in residual color after photographic proceedings even though a basic polymer is included in any of the hydrophilic colloid layers.

These objects are attained with silver halide photosensitive materials wherein at least one hydrophilic colloid layer contains a basic polymer and at least one hydrophilic colloid layer contains a merocyanine dye having an oxazole nucleus as a basic nucleus wherein at least one of the 4- and 5-positions thereof is substituted with an aryl group or a substituted aryl group and having at least two acid groups, such as a sulfo group, a carboxy group, or a phospho group, in the molecule.

DETAILED DESCRIPTION OF THE INVENTION

Examples of acid nuclei, namely, heterocyclic nuclei having a ketomethylene group in the merocyanine dyes used in the present invention, are 5- and 6-membered heterocyclic nuclei such as a pyrazolin-5-one nucleus, a pyrazolidin-3,5-dione nucleus, a hydantoin nucleus, a thiohydantoin nucleus, a 2-thiaoxazolidine-2,4-dione nucleus, a thiazolidine-2,4-dione nucleus, a rhodanine nucleus, an isoxazoline-5-one nucleus, an oxazoline-5-one nucleus, an indolinone nucleus, a barbituric acid nucleus, a thiobarbituric acid nucleus or a 1,3-dioxane-4,6-dione nucleus, etc.

The dyes used in the present invention can be represented by the following formula (I).

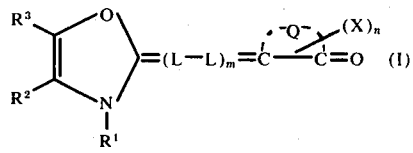

In the formula, $R^1$ represents an alkyl group having 1 to 20 carbon atoms, which may be straight chain, may be branched chain or may contain a ring (for example, a methyl group, an ethyl group, an n-propyl group, an isopropyl group, an n-butyl group, a sec-butyl group, an n-amyl group, a tert-amyl group, a $\gamma$, $\delta$ -dimethylhexyl group, an n-octyl group, a 6-ethyl-4-methyloctyl group, an n-decyl group, a heptadecyl group, a cyclohexyl group or a 2-cyclohexylethyl group, etc.) or a substituted alkyl group having 1 to 20 carbon atoms, for example, an alkyl group having one or more substituents selected from a halogen atom (a fluorine atom, a chlorine atom or a bromine atom, etc.), a cyano group, a carboxy group, an alkoxycarbonyl group having 2 to 10 carbon atoms in the alkoxy moiety thereof which can be further substituted (for example, a methoxycarbonyl group an ethoxycarbonyl group, a butoxycarbonyl group, a benzyloxycarbonyl group or a phenethyloxycarbonyl group, etc.), a sulfo group, a sulfoalkoxy group having 1 to 10 carbon atoms in the alkoxy moiety thereof (for example, a sulfopropoxy group or a sulfopropoxyethoxy group, a sulfopropoxybenzoxy group, etc.), a phospho group, a carbamoyl group, a substituted carbamo group having 1 to 10 carbon atoms (for example, a methylcarbamoyl group, an ethyl carbamoyl group, a depentylcarbamoyl group, a phenylcarbamoyl group, a benzylcarbamoyl group, a diethylcarbamoyl group, an N-methyl-N-phenylcarbamoyl group, a morpholinocarbonyl group, a piperidinocarbonyl group or cyclohexylcarbamoyl group, etc.), an acyl group having 2 to 10 carbon atoms in the alkyl moiety thereof (for example, an acetyl group, a propionyl group, a pivaloyl group, a benzoyl group, a phenacyl group, a methylsulfonyl group, a benzenesulfonyl group or a tosyl group, etc.), an acyloxy group having 2 to 10 carbon atoms in the alkyl moiety thereof (for example, an acetoxy group, a nonanoyloxy group, or a benzoyloxy group, etc.), a hydroxy group, an alkoxy group having 1 to 10 carbon atoms (for example, a methoxy group, an ethoxy group a butoxy group or a decoxy group, etc.), an amino group, a substituted amino group having 1 to 16 carbon atoms (for example, a methylamino group, a ethylamino group, a benzylamino group, a morpholino group, an N-pyrrolidyl group, a dimethylamino group, a diethylamino group, an N,N-diphenethylamino group, an anilino group, an N-methylanilino group, a diphenethylamino group, a p-sulfoanilino group, a chloroanilino group, an acetylamino group, a pivaloylamino group, a benzoylamino group, a phenacylamino group, a methylsulfonylamino group or a tosyl amino group, etc.), a mono- or bicyclic aryl group (for example, a phenyl group or a naphthyl group, etc.), a mono-or bicyclo-heterocyclic group (for example, a thienyl group, a furyl group, an imidazolyl group, a benzimidazolyl group, a benzofuranyl group, a benzothienyl group, a quinolyl group, etc.), a substituted mono- or bicyclic aryl group (for example, substituted with one or more of a carboxy group, a sulfo group, an alkyl group, an alkoxy group, a halogen atom, a substituted amino group, etc. such as a carboxyphenyl group, a sulfophenyl group, a tolyl group, a sulfotolyl group, a methoxyphenyl group, a dichlorophenyl group, a sulfonaphthyl group or a dimethylaminophenyl group, etc.), a mono- or bicyclic aryloxy group which may be substituted (for example, a phenoxy group, or tert-butylphenoxy group, etc.), a mono- or bicyclic aryloxycarbonyl group which may be substituted (for example, with the same aryl group substituents set forth above for the substituted aryl group such as a phenoxycarbonyl group or a methylphenoxycarbonyl group, etc.) and an alkenyl or alkynyl group, which may include a ring, having 2 to 15 carbon atoms (for example, a vinyl group, a propenyl group, a butadienyl group, a cyclohexenyl group, an ethynyl group or a propargyl group, etc.). In addition, any substituent can be utlized if it is conventionally used as a substituent for a nuclear nitrogen atom in known cyanine dyes or merocyanine dyes.

At least one of $R^2$ and $R^3$ represents a mono-, bi- or tricyclic aryl group (for example, a phenyl group, an $\alpha$-naphthyl group or a $\beta$-naphthyl group, etc.) or a mono-, bi- or tricyclic substituted aryl group, for example, an aryl group having as a substituent an alkyl group having 1 to 8 carbon atoms which may be substituted (for example, a methyl group, an ethyl group, a butyl group, an octyl group or a trifluoromethyl group, etc.), an alkoxy group having 1 to 8 carbon atoms (for example, a methoxy group, an ethoxy group or a butoxy group, etc.), an alkylthio group having 1 to 10 carbon atoms (for example, a methylthio group or an ethylthio group, a decylthio group, etc.), a halogen atom (for example, a chlorine atom or a bromine atom, etc.), a nitro group, a cyano group, a sulfo group, a phospho group, a carboxy group, an alkoxycarbonyl group having 2 to 8 carbon atoms (for example, an ethoxycarbonyl group, a butoxycarbonyl group, a heptyloxycarbonyl group, a benzyloxycarbonyl group, etc.), an amino group which may be substituted (for example, an amino group, a dimethylamino group or an acetylamino group), an aralkyl group having 10 or less carbon atoms (for example a phenethyl group), a mono- or bicyclic aryl group having 10 or less carbon atoms (for example, a phenyl group) or a mono- or bicyclic aryloxy group having 10 or less carbon atoms.

Where only one or $R^2$ and $R^3$ represents the above-described aryl group (substituted or unsubstituted), the other of them represents a hydrogen atom, a halogen atom (for example, a chlorine atom or a bromine atom), a cyano group, a carboxy group, an alkoxycarbonyl group having 2 to 8 carbon atoms (for example, an ethoxycarbonyl group or a butoxycarbonyl group, etc.), an alkyl group having 1 to 10 carbon atoms (for example, a methyl group, an ethyl group, a butyl group or a decyl group, etc.), an aralkyl group having 10 or less carbon atoms (for example, a benzyl group or phenethyl group, etc.) or a carboxyalkyl group having 2 to 10 carbon atoms (for example, a carboxymethyl group or a carboxypropyl group, etc.).

In the formula (I), L represents a methine group, and $m$ represents an integer of 0, 1, 2 or 3. One or more methine groups in the methine chain represented by the formula $=(L—L)_m=$ may be substituted with a halogen atom (for example, a chlorine atom or a bromine atom, etc.), an alkyl group having 1 to 8 carbon atoms (for example, a methyl group or an ethyl group, etc.), a substituted alkyl group, for example an alkyl group having an aryl group (a phenyl group, etc.), a hydroxy group, a carboxy group or an alkoxy group having 1 to 4 carbon atoms (for example, a methoxy group or an ethoxy group, etc.) as a substituent, a mono- or bicyclic aryl group (for example, a phenyl group), or a substituted mono- or bicyclic aryl group (for example, a carboxyphenyl group, a tolyl group or a sulfophenyl group, etc.). Further, the methine chain can have a polymethylene bridge so as to form a 5-member or 6-member ring between $R^1$ and L, or between L and an adjacent L or a non-adjacent L.

In the formula (I), Q represents a group of atoms necessary to complete the above described ketomethylene group containing nucleus, specific examples of such nuclei being described hereinbefore.

X represents a carboxy group, a sulfo group, a phospho group or a group which has one or more of a carboxy group, a sulfo group and a phospho group as a substituent, for example, a substituent selected from a sulfoalkyl group (for example, a sulfoethyl group or a sulfobutyl group), a sulfophenyl group, a phosphophenyl group, a sulfoanilino group, a carboxyanilino group, a dicarboxyanilino group, a sulfobenzoylamino group, a sulfoalkoxyalkyl group (for example, a sulfoethoxyethyl group), a sulfobenzoylaminophenyl group, a carboxyanilinophenyl group or a sulfophenoxyphenyl group. These carboxy groups, sulfo groups, phospho groups can also be present in the form of a salt such as an alkali metal salt (e.g., sodium, potassium, etc.) an ammonium salt, or a salt of an organic amine such as diethylamine, triethylamine, morpholine, pyridine, piperidine, etc. $n$ represents an integer of 1, 2 or 3. Where $n$ is 2 or more, the X groups may be the same or different (for example, a sulfoethyl group and a carboxyphenyl group, a sulfopropyl group and a dicarboxyanilinocarbonyl group, or a sulfocarboxyphenyl group and a carboxy group, etc.).

In the formula (I), the total number of carboxyl groups, sulfo groups and phospho groups included in $R^1$, $R^2$, $R^3$, L and X is at least 2 and at most 5.

The nucleus completed by Q can have substituents other than X. For example, an alkyl group having 1 to 15 carbon atoms (for example, a methyl group, an ethyl group, a butyl group, an octyl group, a dodecyl group or a cyclohexyl group, etc.); a substituted alkyl group having 1 to 15 carbon atoms, for example, an alkyl group substituted with a hydroxy group, an amino group, an alkylamino group (for example, an ethylamino group, a dimethylamino group, a morpholino group or a pyrrolidyl group, etc.), an acylamino group (for example, an acetylamino group, a benzoylamino group, a phenacylamino group, a diacetylamino group or a methylsulfonylamino group, etc.), an arylamino group (for example, an anilino group, a naphthylamino group, a methylanilino group or a trichloroanilino group, etc.), an aralkylaino group (for example, a benzylamino group, etc.), a carbamoyl group, an alkylcarbamoyl group, an arylcarbamoyl group (for example, a phenylcarbamoyl group) an aryl group which can be substituted (for example, a phenyl group, a naphthyl group, a tolyl group or a chlorophenyl group, etc.), an alkenyl group (for example, a vinyl group, a propenyl group or a butenyl group, etc.) or a halogen atom (for example, a fluorine atom, a chlorine atom or a bromine atom, etc.); a hydroxy group; an alkoxy group having 1 to 14 carbon atoms which can be substituted (for example, a methoxy group, ethoxy group, butoxy group or phenethyloxy group, etc.); an amino group; a substituted amino group, for example, an amino group having as a substituent an alkyl group having 1 to 14 carbon atoms (for example, a methyl group, ethyl group or butyl group, etc.), an acyl group having 14 or less carbon atoms (for example, an acetyl group, a pivaloyl group, a benzoyl group, a phenacyl group, a methylsulfonyl group, a butylsulfonyl group or a benzenesulfonyl group, etc.), an aryl group (for example, a phenyl group or a naphthyl group, etc.), a substituted aryl group (for example, having an alkyl group, a halogen atom, an alkoxy group, etc. as a substituent such as a tolyl group, chlorophenyl group, a dichlorophenyl group or a methoxyphenyl group, etc.) or an aralkyl group having 14 or less carbon atoms (for example, a benzyl group or a phenethyl group, etc.) or a cyclic amino group such as a morpholino group, a pyrrolidino group, a piperidino group or a piperazino group, etc.; an alkoxycarbonyl group containing an alkoxy group having 1 to 14 carbon atoms which can be substituted (for example, an ethoxycarbonyy group, a butoxycarbonyl group or a benzyloxycarbonyl group, etc.); an aryloxycarbonyl group which can be substituted (for example, a phenoxycarbonyl group or tert-butylphenoxycarbonyl group, etc.); a mono- or bicyclic aryl group (for example, a phenyl group or a naphthyl group, etc.); or a substituted aryl group, for example, an aryl group having as a substituent an alkyl or alkoxy group having 1 to 8 carbon atoms a nitro group, a halogen atom (for example, a chlorine atom or a bromine atom, etc.), an alkoxycarbonyl group having 8 or less carbon atoms, an aryloxy group having 8 or less carbon atoms, a haloalkyl group having 1 to 6 carbon atoms in the alkyl moiety thereof (for example, a chloroethyl group, or a trifluoromethyl group, etc.), an acyl group having 1 to 8 carbon atoms (for example, an acetyl group, a pivaloyl group, a benzoyl group, a phenacyl group, a methylsulfonyl group, a butylsulfonyl group or a benzenesulfonyl group, etc.) or a hydroxy group, etc.

$(X)_n$ and the above-described substituents can be introduced into the following positions, that is, the 1- and 3-positions of the pyrazoline-5-one nucleus, the 1- and 2-positions of the pyrazolidine-3,5-dione nucleus, the 1- and 3-positions of the hydantoin and thiohydantoin nuclei, the 3-position of the oxazolidine-2,4-dione, the 2-thioxazolidine-2,4-dione, the thiazolidine-2,4-dione and the rhodanine nuclei, the 3-position of the isoxazoline-5-one nucleus, the 2-position of the oxazoline-5-one nucleus, the 1- and b 5-positions of the indolinone nucleus and, if desired, the 4-, 6- and 7-positions thereof, the 1- and 3-positions of the barbituric acid and thiobarbituric acid nuclei, and the 2-position of the 1,3-dioxane-4,6-dione nucleus.

Preferred dyes used in the present invention are those having the formula (I) wherein the substituent $R^1$ represents an alkyl group, a sulfoalkyl group, a phosphoalkyl group, a sulfoaralkyl group or a carboxyalkyl group, one of the substituents $R^2$ and $R^3$ represents a phenyl group, a tolyl group, a naphthyl group, an acylaminophenyl group, a chlorophenyl group or a sulfophenyl group, and the other of $R^2$ and $R^3$ represents a hydrogen atom, a lower alkyl group having 1 to 6 carbon atoms, a carboxyalkyl group, an alkoxycarbonyl group having 2 to 6 carbon atoms, an aralkyl group having 7 to 10 carbon atoms, a phenyl group, a tolyl group or a sulfophenyl group, the nucleus completed by Q is a pyrazoline-5-one nucleus, an oxazolone nucleus, an isoxazolone nucleus, a barbituric acid nucleus or an indolinone nucleus, and the substituent X represents a carboxy group, a carboxyalkyl group, a sulfoalkyl group, a phosphoalkyl group, a carboxyphenyl group, a dicarboxyphenyl group, a sulfophenyl group, a phosphophenyl group, a disulfophenyl group, a sulfobenzoylamino group, or a disulfobenzoylamino group.

Particularly preferred dyes are those having the formula (I) wherein the substituent $R^1$ represents a sulfoalkyl group and $R^2$ and $R^3$ each represents a phenyl group, or $R^1$ represents an alkyl group and $R^2$ and $R^3$ each represents a sulfophenyl group, the nucleus completed by Q represents a pyrazoline-5-one nucleus, an isoxazolone nucleus or a barbituric acid nucleus, and the substituent X represents a sulfoalkyl group, a sulfophenyl group, a dicarboxyphenyl group or a disulfophenyl group and $n$ is 1, or the substituent X represents a sulfoalkyl group, a carboxyalkyl group, a sulfophenyl group or a carboxyphenyl group and $n$ is 2, and total number of sulfo groups and carboxy groups present in the molecule is 2 or 3.

Examples of the merocyanine dyes used in the present invention are as follows. However, the present invention is not to be construed as being limited in these examples.

The value shown in the parenthesis is the absorption maximum wavelength of a 0.0005% methanol solution.

I-1

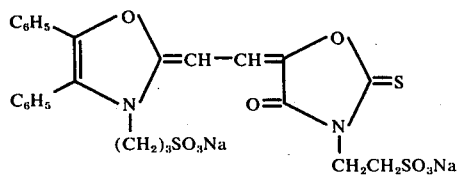

(490 nm)

I-2

-continued
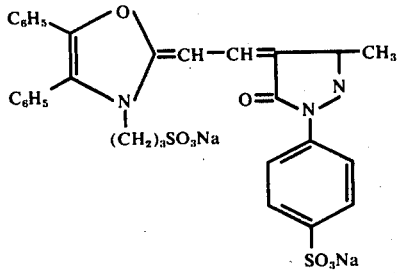
(456 nm)
I-3
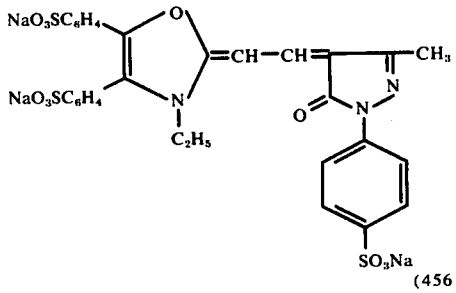
(456 nm)
I-4
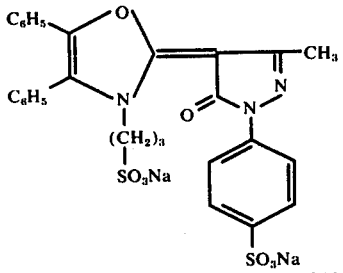
(346 nm)
I-5
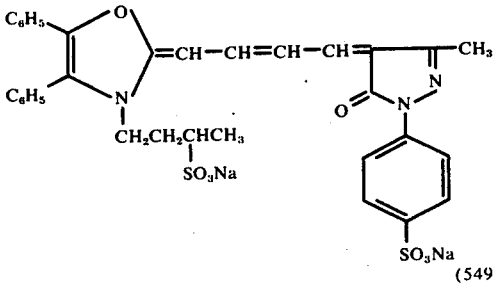
(549 nm)
I-6
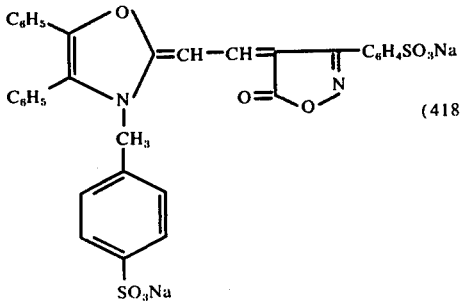
(418 nm)
I-7

-continued
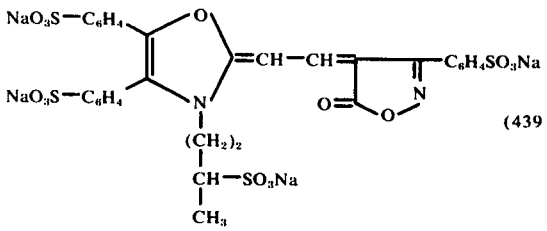
(439 nm)
I-8
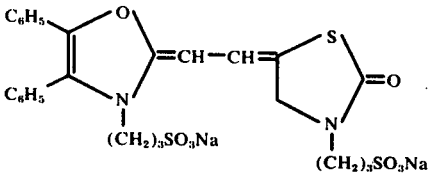
(466 nm)
I-9
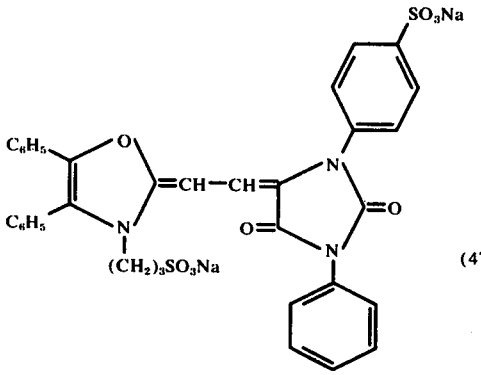
(478 nm)
I-10
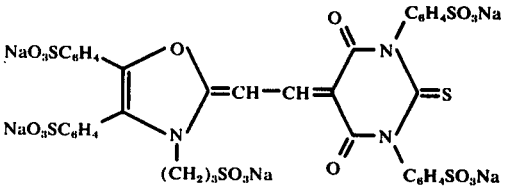
(470 nm)
I-11
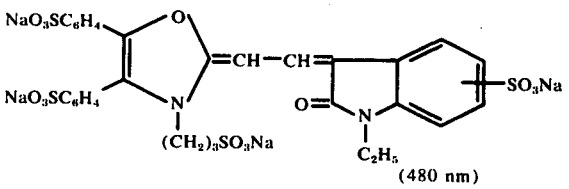
(480 nm)
I-12
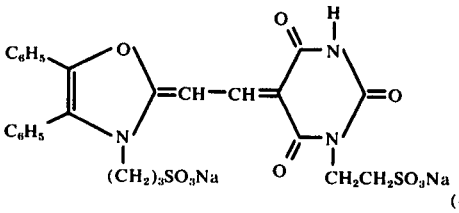
(427 nm)
I-13

-continued
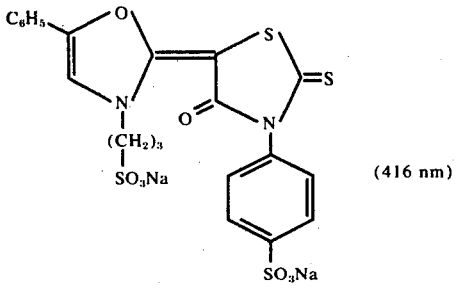
(416 nm)
I-14
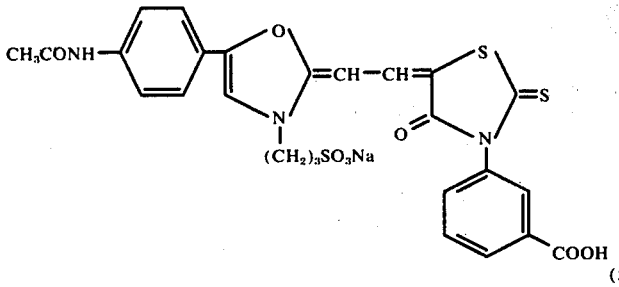
(521 nm)
I-15
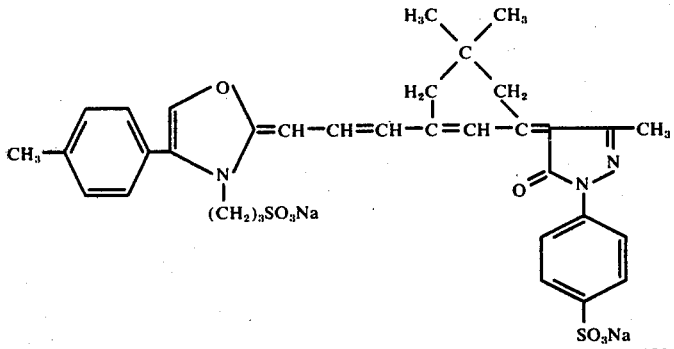
(650 nm)
I-16
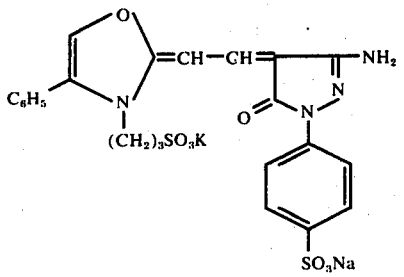
(431 nm)
I-17
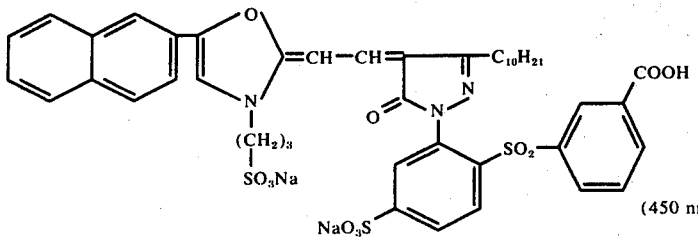
(450 nm)
I-18

-continued
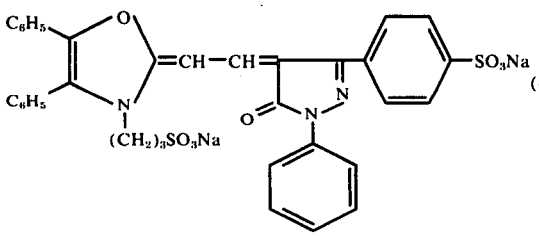
(459 nm)
I-19
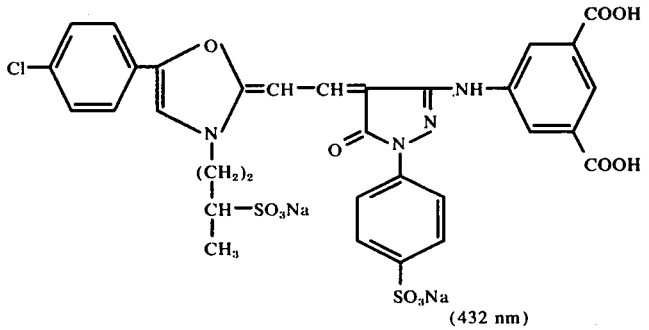
(432 nm)
I-20
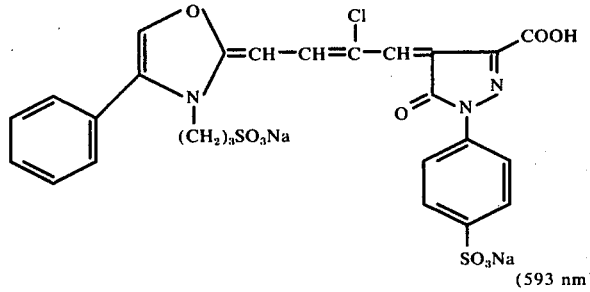
(593 nm)
I-21
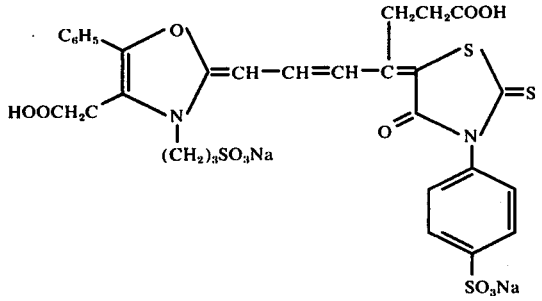
(604 nm)
I-22
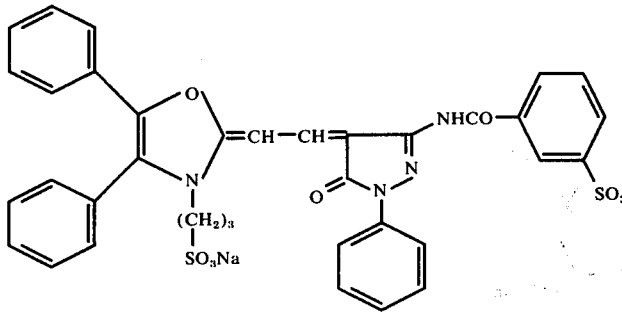
(458 nm)
I-23

-continued

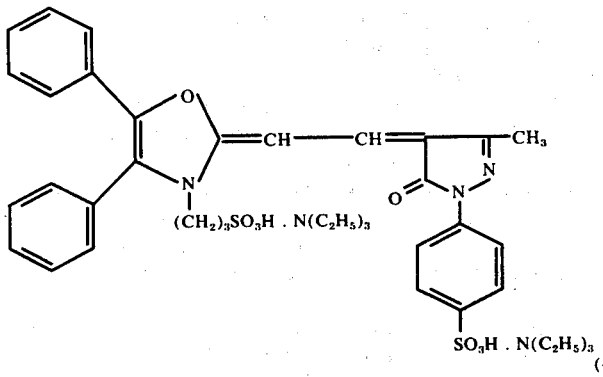

(456 nm)

The merocyanine dyes used in the present invention can be easily synthesized by persons skilled in the art according to processes for preparing known merocyanine dyes, and intermediates therefor can also be easily synthesized according to processes for preparing intermediates of known merocyanine dyes. For example, the merocyanine dyes used in the present invention can be easily synthesized by reacting suitable intermediate compounds such as anilinomethylene compounds, acetoanilidomethylene compounds, mercapto compounds or halo compounds with active methylene compounds or active methyl compounds using a suitable basic condensing agent, such as triethylamine, pyridine, piperidine, sodium acetate, potassium acetate, etc., according to processes described in, for example, Japanese Patent Publication No. 24696/1971; E.D. Sych, Zh.N. Belaya, L.P. Umanskaya, E.D. Smaznaya - I'lina; *Ukr. Khim. Zh*, 32 (3), 274 (1966); B. Davidson, *J. Am. Chem. Soc.*, 70, 3426 (1948); U.S. Pat. Nos. 3,531,287, 2,493,747, 3,440,052 and 3,440,051, British Pat. No. 1,265,485, Japanese Patent Publication No. 27063/1969; Chem. Ber., 10, 2048; U.S. Pat. No. 3,455, 684, British Pat. No. 1,030,392, and U.S. Pat. Nos. 3,480,439, 3,411,916, 3,364,026, 3,352,680, 3,251,691, 3,288,610, 3,567,719, 2,743,273, 2,856,404, 2,882,159 and 2,778,822. Examples of the process for preparing the dyes are shown in the following. Unless otherwise indicated herein, all ports, percents, ratios and the like are by weight.

SYNTHESIS EXAMPLE 1

Synthesis of
4-{2-[4,5-Diphenyl-3-(3-sulfopropyl)oxazolinylidene]ethylene}-3-methyl-1-p-sulfophenyl-2-pyrazoline-5-one disodium salt (Dye 2)

10 g of anhydro-2-(2-anilinovinyl)-4,5-diphenyl-3-(3-sulfopropyl)oxazolium hydroxide and 5.5 g of 3-methyl-1-p-sulfophenyl-2-pyrazoline-5-one were added to 100 ml of γ-butyrolactone, and then 10 ml of acetic anhyride was added thereto. The mixture was heated to 130° to 140° C with stirring on an oil bath. After 30 minutes, 12 ml of triethylamine was added dropwise thereto and the mixture was stirred at this temperature for 60 minutes. After being cooled on standing, 50 ml of acetone was added thereto and the mixture was stirred while adding dropwise 80 ml of an acetone solution of 9 g of sodium iodide at 25° C. The precipitated dye was separated by filtration. Crude crystals of this dye were added to 300 ml of ethanol and washed by boiling for 30 minutes to obtain 10.4 g of the dye. Melting point: above 300° C.

SYNTHESIS EXAMPLE 2

Synthesis of
4-{4-[4,5-Biphenyl-3-(3-sulfobutyl)oxazolinylidene]-2-butenylidene}-3-methyl-1-p-sulfophenyl-2-pyrazoline-5-one disodium salt (Dye 5)

15 g of anhydro-2-(4-ethoxy-1,3-butenylidene)-4,5-diphenyl-3-(3-sulfobutyl)oxazolium hydroxide and 8.4 g of 3-methyl-1-p-sulfophenyl-2-pyrazoline-5-one were added to 500 ml of ethanol. Then 15 ml of triethylamine was added dropwise thereto, and the mixture was refluxed for 1 hour under stirring. After this, half the amount of ethanol was removed by distillation and the reaction solution was filtered. 10 g of sodium iodide was added to the filtrate, and the mixture was heated to about 40° C for 15 minutes. After being cooled on standing, the precipitated crystals were separated by filtration. The resulting crude crystals were added to 300 ml of ethanol and washed by boiling for 30 minutes to obtain 11.7 g of the dye. Melting point: above 300° C.

SYNTHESIS EXAMPLE 3

Synthesis of
4-{2-[4,5-diphenyl-3-(3-sulfobutyl)oxazolinylidene]ethylidene}-3-phenylisoxazoline-5-one sulfonate sodium salt (Dye 7)

8.9 g of anhydro-2-(2-anilinovinyl)-4,5-diphenyl-3-(3-sulfobutyl)oxazolium hydroxide and 4 g of 3-phenylisoxazoline-5-one were dissolved in 50 ml of acetic acid. Then 5 ml of acetic anhydride and 30 ml of triethylamine were added thereto and the mixture was refluxed by boiling for 30 minutes with stirring. After cooling, diethyl ether was added thereto and the precipitated crystals were separated by filtration. The resulting crude crystals were dissolved in ethanol and a methanol solution containing 1.2 equivalents of sodium iodide was added thereto. The precipitated crystals were separated by filtration and washed with 50 ml of boiling methanol to obtain 5.7 g of 4-{2-[4,5-diphenyl-3-(3-sulfobutyl)oxazolinylidene]ethylidene}-3-phenylisoxazoline-5one monosodium salt having a melting point above 300° C and λmaxMeOH of 449.5 nm. 5 g of this merocyanine dye was dissolved in a mixture of 20 ml of concentrated sulfuric acid and 30 ml of 20% fuming sulfuric acid, and 0.2 g of ferric chloride hexahydrate was added thereto. The mixture was heated to 100° to 110° C on an oil bath for 1 hour with stirring. After being cooled with ice, the mixture was poured into 2 liters of acetone and the precipitated crystals were separated by filtration. The crude crystals were dissolved in 125 ml of ethanol and the insoluble materials were removed by filtration. To this ethanol solution, 25 ml of a methanol solution of 5 g of sodium iodide was added. The precipitated crystals were separated again by filtration and recrystallized from an aqueous methanol solution to obtain 2.5 g of the merocyanine dye sulfonate sodium salt having a melting point above 300° C.

SYNTHESIS EXAMPLE 4

Synthesis of 5-[5-phenyl-3-(3-sulfopropyl)oxazolinylidene]-3-p-sulforhodanine disodium salt (Dye 13)

10 g of anhydro-2methylthio-5-phenyl-3-(3-sulfopropyl)oxazolium hydroxide and 9.3 g of 3-p-sulophenylrhodanine were added to 250 ml of acetonitrile, and 30 ml of triethylamine was added dropwise thereto. The mixture was refluxed by boiling for 2 hours with stirring. After being cooled by ice, the precipitated crystals were separated by filtration. The resulting crude crystals were dissolved in 1 liter of ethanol and 50 ml of a methanol solution containing 10 g of sodium iodide was added thereto. Then about 700 ml of methanol was removed by distillation. After being cooled on standing, the precipitated crystals were separated by filtration and washed with 100 ml of boiling methanol to obtain 11.6 g of the crystallized merocyanine dye having a melting point above 300° C.

SYNTHESIS EXAMPLE 5

Synthesis of 4-{6-[4-p-tolyl-3-(3-sulfopropyl)oxazolinylidene]-1,3-(2,2-dimethyl)propano-2,4-hexadienylidene}-3-methyl-1-p-sulfophenyl-2-pyrazoline-5-one disodium salt (Dye 15)

10 g of anhydro-2-(2-anilinovinyl)-4-p-tolyl-3-(3-sulfopropyl)oxazolium hydroxide and 9.7 g of 4-(3,5,5-trimethylcyclo-2-hexenylidene)3-methyl-1-p-sulfophenyl-2-pyrazoline-5-one were added to 100 ml of γ-butyrolactone. After adding 12 ml of acetic acid anhydride, the mixture was heated to 130° to 140° C on an oil bath with stirring. After 10 minutes, 15 ml of triethylamine was added, and the mixture was stirred for 15 minutes at this temperature. The reaction mixture was then cooled with water and 50 ml of acetone was added thereto. Then, a solution of 10 g of sodium iodide in 80 ml of acetone was added thereto with stirring at room temperature (about 20 –30° C). After being heated to 50° C on a water bath for 15 minutes, the mixture was cooled with ice and the precipitated crystals were separated by filtration. Crude crystals of the separated dye were added to 300 ml of ethanol and washed by boiling for 30 minutes to obtain 9.5 g of the dye. Melting point: above 300° C (decomposing gradually above 200° C).

Other merocyanine dyes represented by the formula (I) can be easily synthesized also in the same manner as described above using a suitable solvent such as ethanol, isopropanol, acetonitrile, acetonitrile-dimethylformamide, acetic acid anhydride, acetic acid, dimethylformamide, nitrobenzene, γ-butyrolactone or m-cresol and, if desired, a suitable basic condensing agent such as triethylamine, piperidine, 1,5-diazabicyclo(5,4,-0)undecene-5, morpholine or sodium acetate. The merocyanine dyes used in the present invention can be polycyclic (tricyclic and tetracyclic) merocyanine dyes which can be synthesized from merocyanine dyes represented by the formula (I) using a known process. Namely, they can be easily synthesized by the same process as described in, for example, R. H. Glauert, F. G. Marn, A. J. Wilkinson, *J. Chem. Soc.*, 1955, 1490; British Pat. No. 789,077 and U.S. Pat. Nos. 2,728,766 and 2,739,965.

In the photographic sensitive materials of the present invention, the dye can be introduced into the hydrophilic colloid layer using a conventional method. Namely, an aqueous solution of the dye at a suitable concentration can be added to an aqueous solution of the hydrophilic colloid, an the resulting solution coated using a known method on a support or a layer of the photographic sensitive material.

The amount of the dye to be employed in the aqueous solution of the hydrophilic colloid can be chosen within the range of solubility of the dye according to the purpose. In general, an aqueous solution of the dye at a concentration of about 0.5 to 3% by weight is coated at a coverage of about 8 to 800 mg of the dye per $m^2$ of the photosensitive material. Although the amount of the basic polymer in the hydrophilic colloid layer is not limited, a preferred amount is that amount equivalent to about 4 to 20 basic functional groups being present per molecule of the dye present in the hydrophilic colloid layer.

In the present invention, although it is advantageous to add the dye to a coating solution for forming a hydrophilic colloid layer containing a basic polymer, the dye can be added to a coating solution for forming another hydrophilic colloid layer, namely, a photographic emulsion layer or a coating solution for forming another non-light sensitive layer. In the latter case, it is preferred to introduce the dye into a layer which is near and preferably adjacent the basic polymer-containing layer. The dye diffuses into the layer which contains the basic polymer, even if the dye is introduced into a layer which does not contain the basic polymer, and consequently the basic polymer-containing layer is selectively dyed in the finished photosensitive material. The dye can be introduced into two or more layers.

The hydrophilic colloid layer containing a basic polymer can be a single layer or can comprise two or more layers. This layer (or layers) can be positioned above a photographic emulsion layer (i.e., farther from the support), or can be positioned between photographic emulsion layers if a plurality of photographic emulsion layers present, or between a photographic emulsion layer and the support. The layer dyed selectively due to the presence of the basic polymer can have the function of a filter layer, an antihalation layer or a layer for another purpose according to its position.

In the photosensitive materials of the present invention, a basic polymer is included in at least one hydrophilic colloid layer. The basic polymer is a water-soluble high molecular weight material which has basic groups in the main chain or a branched chain thereof and which is compatible with gelatin. Basic hydrophilic high molecular weight materials which are generally used for mordanting acid dyes for the hydrophilic colloid layer of silver halide photographic sensitive materials can be used as such basic polymers. For example, it is possible to use polymers derived from ethylenically unsaturated compounds having dialkylaminoalkyl ester groups as described in British Pat. No. 685,475, copolymers of compounds as described in U.S. Pat. No. 2,839,401, maleic acid anhydride copolymers or derivatives thereof as described in British Pat. No. 906,083, polymers produced by reacting polyvinylalkyl ketones with aminoguanidine as described in British Pat. No. 850,281, polymers having a 2-methylimidazole nucleus in a side chain as described in U.S. Pat. No. 3,445,231, addition polymers of bisacrylamide and a secondary diamine or the quaternary salts thereof as described in Japanese Patent Application (OPI) No. 24733/1973, copolymers of three or four monomers including polyvinylpyridine or polyvinylquinoline as described in British Pat. Nos. 765,520 and 766,202, and polymers as described in German Patent Applications (OLS) Nos. 1,914,361 and 1,914,362.

The emulsion layers and other hydrophilic colloid layers of the photosensitive materials can contain other known water-soluble dyes in addition to the water-soluble dyes of the present invention in an amount which does not materially damage the effect of the present invention. It is particularly advantageous to use two or more dyes as a combination when a desired spectral absorption characteristic is not obtained by using one dye. Examples of dyes which can be used include oxonol dyes as described in Japanese Patent Application (OPI) Nos. 85130/1973 and 5125/1974 and U.S. Pat. Nos. 3,247,127, 3,653,905, 2,533,472 and 3,379,533, hemioxonol dyes ad described in British Pat. No. 584,609, U.S. Pat. No. 3,687,670 and French Pat. No. 1,421,679, styryl dyes as described in U.S. Pat. No. 1,845,404 and merocyanine dyes as described in U.S. Pat. No. 2,493,747, etc. It is also possible for an alkali soluble pigment such as manganese dioxide or a bleachable pigment such as colloidal silver to be present together with the dye of the present invention.

The layer to be dyed according to the present invention can contain a high molecular mordanting agent together with the hydrophilic colloid. For example, it is possible to use polymers derived from ethylenically unsaturated compounds having dialkylaminoalkyl ester residues as described in British Pat. No. 685,475, copolymers of such compounds as described in U.S. Pat. No. 2,839,401, maleic anhydride copolymers or derivatives thereofs as described in British Pat. No. 906,083, polymers produced by reacting polyvinylalkyl ketones with aminoguanidine as described in British Pat. No. 850,281, polymers having a 2-methylimidazole nucleus in a side chain as described in U.S. Pat. No. 3,445,231, addition polymers of bisacrylamide and a secondary diamine or the quaternary salts thereof as described in Japanese Patent Application (OPI) No. 24733/1973, copolymers of three of four monomers including polyvinylpyridine or polyvinylquinoline as described in British Pat. Nos. 765,520 and 766,202, polymers described in German Patent Applications (OLS) Nos. 1,914,361 and 1,914,362, and other various polymers which are known as mordanting agents for acid dyes suitable for photographic sensitive materials.

Various additives having various functions for enhancing the quality of the photographic light-sensitive materials such as a hardener, a coating aid, a platicizer, a lipping agent, a matting agent, an emulsion polymerized latex, an antistatic agent an ultraviolet light absorbing agent, an antioxidant, and the like can be incorporated in the hydrophilic colloidal layer of the light-sensitive material of the present invention. These additives are described below.

In the light-sensitive material of the present invention, photographic emulsion layers and other hydrophilic colloidal layers can be hardened by adding a conventionally used hardener. Various kinds of compounds individually or in combination, such as aldehydes (e.g., glyoxal described in U.S. Pat. No. 1,870,354, glutaraldehyde described in British Pat. No. 825,544, etc.), N-methylol compounds (e.g., N,N'-dimethylolurea, dimethylolhydantoin described in British Pat. No. 676,628, etc.), dioxane derivatives (e.g., dihydroxydioxane described in U.S. Pat. No. 3,380,829, derivatives thereof described in Japanese Patent Publication No. 38713/71, etc.), epoxy group-containing compounds (e.g., compounds described in U.S. Pat. Nos. 3,047,394, 3,091,537, Japanese Patent Publication No. 7133/59, etc.), compounds containing reactive halogens (e.g., 2,4-dichloro-6-hydroxy-1,3,5-triazine, described in U.S. Pat. No. 3,325,287, mucohalic acids (e.g., mucochloric acid described in U.S. Pat. No. 2,080,019, mucobromic acid, the derivatives thereof described in Japanese Patent Publication No. 1,872/71, etc.), bis(methanesulfonic acid ester) described in U.S. Pat. No. 2,726,162, sulfonyl compounds (e.g., bis(benzenesulfonyl chloride described in U.S. Pat. No. 2,725,925, etc.), aziridine compounds (e.g., compounds described in Japanese Patent Publication Nos. 4,212/58 and 8,790/62, etc.), divinylsulfones (e.g., compounds described in U.S. Pat. No. 2,579,871, etc.), compounds containing a reactive olefin bond (e.g., divinylketones as described in German Pat. No. 872,153, compounds containing an acryloyl group described in U.S. Pat. Nos. 3,255,000, 3,635,718, British Pat. No. 994,869, West German Pat. No. 1,090,427, etc.), alkylenebismaleimides described in U.S. Pat. Nos. 2,992,109, etc.), isocyanates described in U.S. Pat. No. 3,103,437, carbodiimides described in U.S. Pat. No. 3,100,704, isoxazole derivatives (e.g., compounds described in U.S. Pat. Nos. 3,321,313, 3,543,292, etc.) carbamoyl chloride derivatives described in Japanese Patent Publication No. 6,899/66, high molecular weight hardeners (e.g., dialdehyde starch described in U.S. Pat. No. 3,057,723, compounds described in Japanese Patent Publication No. 12,550/67, etc.), inorganic hardeners (e.g., chromimum alum, chromium acetate, zirconium sulfate, etc.), and the like can be used as the hardener.

The photographic emulsion layers and other hydrophilic colloidal layers in the light-sensitive material of the present invention can contain various known surface active agents as a coating aid or for antistatic purposes, improvement of sliding properties and other purposes. For example, nonionic surface active agents such as saponin, polyethylene glycol, polyethylene glycol-polypropylene glycol condensates described in U.S. Pat. No. 3,294,540, polyalkylene glycol ethers described in U.S. Pat. Nos. 2,240,472 and 2,831,766, polyalkylene glycol esters, polyalkylene glycol amides, and the like; anionic surface active agents such as alkylcarboxylic acid salts, alkylsulfonic acid salts, alkylbenzenesulfonates, alkylnaphthalenesulfonates, alkylsulfates, N-acylated N-alkyltaurines described in U.S. Pat. No. 2,739,891, malcopimelates described in U.S. Pat. Nos. 2,359,980, 2,409,930, and 2,447,750, the compounds described in U.S. Pat. Nos. 2,823,123 and 3,415,649, and the like; and amphoteric surface active agents such as the compounds described in British Pat. No. 1,159,825, Japanese Patent Publication No. 378/65, Japanese Patent Application (OPI) No. 43,924/73, U.S. Pat. No. 3,726,683, etc. can be used.

The hydrophilic colloidal layers in the light-sensitive material of the present invention can contain a slipping agent such as the higher alcohol esters of higher fatty acids described in U.S. Pat. Nos. 2,588,756 and 3,121,060; casein described in U.S. Pat. No. 3,295,979, higher fatty acid calcium salts described in British Pat. No. 1,263,722, silicone compounds described in British Pat. No. 1,313,384, U.S. Pat. Nos. 3.042,522 and 3,489,567. A dispersion of liquid paraffin can also be used for this purpose.

The photographic emulsion layers and other hydrophilic colloidal layers in the light-sensitive material of the present invention can contain a plasticizer such as glycerin, diols described in U.S. Pat. No. 2,960,404, trihydric aliphatic alcohols described in U.S. Pat. No. 3,520,694, or the like.

The photographic emulsion layers and other hydrophilic colloidal layers in the light-sensitive material of the present invention can contain a dispersion of a water-insoluble synthetic polymer or of a polymer slightly soluble in water for the purpose of inproving the dimensional stability and the like. For example, polymers containing as a monomer alkyl acrylates, alkyl methacrylates, alkoxy acrylates, alkoxy methacrylates, glycidyl acrylate, glycidyl methacrylate, acrylamide, methacrylamide, vinyl acetate, acrylonitrile, olefins or styrene, individually or in combination or containing these monomers and acrylic acid, $\alpha,\beta$-unsaturated dicarboxylic acids, sulfoalkyl acrylates, styrenesulfonic acid or the like can be used. As specific examples, there are illustrated the polymers described in U.S. Pat. Nos. 2,376,055, 3,607,290, 3,645,740, British Pat. Nos. 1,186,699, 1,307,373, U.S. Pat. Nos. 3,062,674, 2,739,137, 3,411,911, 3,488,708, 3,635,715, 2,853,457.

The hydrophilic colloidal layers in the light-sensitive material of the present invention can contain a matting agent such an inorganic particles, e.g., silica described in Swiss Pat. No. 330,158, glass powder described in French Pat. No. 1,296,995, carbonates of alkaline earth metals, cadmium or zinc described in British Pat. No. 1,173,181; starch described in U.S. Pat. No. 2,322,037; and organic particles, e.g., starch derivatives described in Belgian Pat. No. 625,451 or British Pat. No. 981,198; polyvinyl alcohol described in Japanese Patent Publication No. 3,643/69, polystyrene or polymethyl methacrylate described in Swiss Pat. No. 330,158, polyacrylonitrile described in U.S. Pat. No. 3,079,257 and polycarbonates described in U.S. Pat. No. 3,022,169.

The photographic emulsion layers and other hydrophilic colloidal layers in the light-sensitive material of the present invention can contain an ultraviolet light-absorbing agent such as the compounds of the benzophenone series, the benzotriazole series, the thiazolidine series or the like. These ultraviolet light-absorbing agents can be mordanted to a specific layer in the same manner as with the dyes.

The photographic emulsion layers and other hydrophilic colloidal layers in the light-sensitive material of the present invention can contain a brightening agent of the stilbene series, the triazine series, the oxazole series, the coumarin series or the like. Water-soluble compounds can be used and, in addition, water-insoluble brightening agents can be used in the form of a dispersion.

The hydrophilic colloidal layers in the light-sensitive material of the present invention can contain compounds used for the purpose of preventing color fog of color light-sensitive materials or preventing color mixing between layers, such as alkylhydroquinones, dialkylhydroquinones, aryl-substituted hydroquinones, sulfo-substituted hydroquinones, high molecular weight compounds containing hydroquinone residues, catechol derivatives, aminophenol derivatives, gallic acid derivatives, ascorbic acids or the like in the form of, if necessary, a dispersion. Specific examples of these compounds are the compounds described in British Pat. Nos. 557,750, 557,802, U.S. Pat. Nos. 2,366,327, 2,360,290, 2,403,721, 2,728,659, 2,732,300, 2,735,765, 2,418,613, 2,675,314, 2,710,801, 2,816,028, 2,360,290, French Pat. No. 885,982, U.S. Pat. Nos. 2,336,327, 2,403,721, British Pat. No. 1,133,500, Japanese Patent Publication No. 13,496/68, U.S. Pat. Nos. 3,457,079, 2,360,290, and 2,384,658. In order to introduce these compounds into the hydrophilic colloid layer, a method of dispersion in a hydrophilic colloid together with a high-boiling organic solvent such as an aliphatic ester, an aromatic carboxylic acid alkyl ester, an aromatic phosphoric acid ester, an aromatic ether, or the like, a method of addition as an alkaline aqueous solution to a hydrophilic colloid, and a like method can be employed.

The silver halide photographic emulsion to be used for the light-senstive material of the present invention can be prepared using the various conventionally known techniques depending upon the end-use of the light-sensitive material so as to provide suitable characteristics.

Any of silver chloride, silver chlorobromide, silver bromide, silver bromoiodide, silver chlorobromoiodide and the like can be used as the silver halide, and the halogen content ratio is not particularly limited. As a protective colloid used upon formation of the silver halide, gelatin derivatives such as acylated gelatin (e.g., phthaloylated gelatin, succinoylated gelatin, etc.) and grafted gelatin prepared by grafting acrylamide or hydroxyalkyl (meth)acrylates; and high polymers such as a copolymer comprising three monomers, acrylic acid (or methacrylic acid), acrylamide (or methacrylamide) and an amine derivative of either of them (for example, N-(dialkylaminoalkyl)acrylamide), individually or in combination, as well as gelatin commonly used, can be employed.

Known processes can be employed for preparing the silver halide emulsion. For example, the principles and processes described in C. E. K. Mees and T. H. James; *The Theory of the Photographic Process*, 3rd Ed., MacMillan Co., New York (1966); Grafkides; *Chimie Photographique*, 2nd. Ed., Photocinema Paul Montel, Paris (1957); H. Frieser; *Die Grundlagen der Photographische Prozesse mit Silberhalogeniden*, Vol. 2, pp. 609–674 and 735–743, Akademische Verlaggesellschaft, Frankfurt-am-Main (1968); and the like can be used. Any of an acidic process, a neutral process and an ammoniacal process can be used, and a single jet or a double jet process (also called a twin jet process) can be used. The so called controlled double jet process as described in *Berichte der Bunsengesellschaft fur Physikalische Chemie*, Band 67, p.349 et seq. (1963) can be used as the occasion demand. Such a process is advantageous for obtaining an emulsion having an extremely narrow particle size distribution. The silver halide grains can be in any of a cubic form, an octahedral form, a tetradecahedral form (both of the foregoing two forms coexisting), various twin forms or in a mixed form thereof. The silver halide emulsion can contain either coarse grains or fine grains with the mean value of grain diameter or edge length (or a corresponding value showing the grain size) (numerical average measured according to a projection method) being less than about 0.2 μm, about 0.2 to 1 μm, and more than about 1 μm. The grain size distribution with the grain size being in the sense as described above can be either narrow or broad. The silver halide emulsion can be either physically ripened or not physically ripened. Usually, the soluble salts are removed from the emulsion after the formation of precipitate or after physical ripening. As the means for salt removal, a noodle washing method, long well known, or a flocculation method utilizing inorganic salts containing a multivalent anion (e.g., ammonium sulfate, etc.), anionic surface active agents, anionic polymers (e.g., polystyrenesulfonic acid, etc.) or gelatin derivatives (e.g., aliphatic or aromatic acylated gelatin, etc.) can be employed.

As the silver halide emulsion, an emulsion which has not been chemically sensitized (so-called non-after-ripened emulsion) can be used, although the emulsion can be chemically sensitized. Suitable processes for chemical sensitization include the processes described in Mees and James, supra, Grafkides, supra, or Frieser supra, and other various known processes. That is, sulfur sensitization using the compounds containing a sulfur capable of reacting with silver ion such as a thiosulfate or the compounds described in U.S. Pat. Nos. 1,574,944, 2,278,947, 2,410,689, 3,189,458, 3,501,313, French Pat. No. 2,059,245 or using active gelatin; reduction sensitization using a reducing agent such as stannous chloride described in U.S. Pat. No. 2,487,850, amines described in U.S. Pat. Nos. 2,518,698, 2,521,925, 2,521,926, 2,419,973 and 2,419,975, iminoaminomethanesulfinic acid described in U.S. Pat. No. 2,983,610 or silane compounds described in U.S. Pat. No. 2,694,639, or according to the process described in H. W. Wood, *Journal of Photographic Science*, Vol. 1, p.163 et seq. (1953); gold sensitization using a gold complex salt described in U.S. Pat. No. 2,399,083 or gold-thiosulfate complex salt; sensitization using salts of noble metals such as platinum, palladium, iridium, rhodium, ruthenium described in U.S. Pat. Nos. 2,448,060, 2,540,086, 2,566,245 and 2,566,263, individually or in combination can be employed. Also, selenium sensitization described in U.S. Pat. No. 3,297,446 can be used in place of or together with the sulfur sensitization.

The photographic emulsions used for the photosensitive materials of the present invention can be spectrally sensitized for long wavelength blue light, green light, red light or infrared light using sensitizing dyes. As sensitizing dyes, cyanine dyes, merocyanine dyes, complex cyanine dyes, complex merocyanine dyes, holopolar cyanine dyes, styryl dyes, hemicyanine dyes, oxonol dyes and hemioxonol dyes can be used. The cyanine dyes can have any heterocyclic ring selected from pyrroline, oxazoline, thiazoline, pyrrole, oxazole, thiazole, selenazole, imidazole, pyridine and tetrazole as a basic nucleus. These nuclei can have alkyl groups, alkenyl groups, alkylene groups, hydroxyalkyl groups, carbonyalkyl groups, sulfoalkyl groups, aminoalkyl groups, alkoxyalkyl groups, sulfo-hydroxy-alkyl groups, or sulfo-alkokyalkyl groups as substituents. Further, these nuclei can be condensed with an aromatic or alicyclic hydrocarbon ring or a heterocyclic ring which may be unsubstituted or substituted with halogen atoms, alkyl groups, alkoxy groups, hydroxy groups, cyano groups, carboxy groups, alkoxycarbonyl groups, alkylamino groups, dialkylamino groups, acylamino groups, acyl groups, phenyl groups or fluoroalkyl groups. The cyanine dyes can be symmetrical or can be asymetrical and the methine and polymethine chains of the dyes can be substituted with an alkyl group, a phenyl group, a substituted phenyl group such as a carboxyphenyl group, an isophorone nucleus or a heterocyclic nucleus. As the merocyanine dyes, those having an acid nucleus as a 2-thiaoxazolidinedione acid nucleus, a rhodanic acid nucleus, a thiohydantoin nucleus, a barbituric acid nucleus or pyrazolone nucleus together with the above described basic nucleus can be used. The above described acid nuclei can be subsituted with alkyl groups, alkylene groups, phenyl groups, hydroxyalkyl groups, carboxyalkyl groups, sufoalkyl groups, alkoxyalkyl groups, aminoalkyl groups or acylamino groups. These sensitizing dyes can be used individually or can be used as a combination thereof. Quite a large number of combinations of sensitizing dyes for supersensitization are known.

The emulsions can contain materials which exhibit a supersensitization function without absorbing visible light, for example, compounds having a pyrimidinyl group of a triazinyl group described in U.S. Pat. Nos. 2,933,390, 3,511,664, 3,615,613, 3,615,632 and 3,615,641, aromatic acid-formaldehyde condensation products, azaindenes or cadmium salts, together with the sensitizing dyes.

The photographic emulsions in the light-sensitive material of the present invention can contain various additives for the purpose of preventing fog or stabilizing the photographic properties during production steps, during storage of the light-sensitive material or during development processing. That is, azoles (e.g., benzotriazole, benzothiazolium salts described in U.S. Pat. No. 2,131,038, aminobenzimidazole described in U.S. Pat. No. 2,324,123, etc.); nitroazoles (e.g., nitrobenzindazole, nitrobenzotriazole, nitrobenzimidazoles described in British Pat. No. 403,789, nitroaminobenzimidazoles described in U.S. Pat. No. 2,324,123, etc.); halogen-substituted azoles (e.g., 5-chlorobenzimidazole, 5-bromoimidazole, 6-chlorobenzimidazole, etc.); mercaptoazoles (e.g., mercaptothiazole derivatives described in U.S. Pat. No. 2,824,001, mercaptobenzothiazole, the derivative thereof described in U.S. Pat. No. 2,697,099, mercaptoimidazole derivatives described in U.S. Pat. No. 3,252,799, mercaptobenzimidazole, mercaptoxadiazole described in U.S. Pat. No. 2,843,491, mercaptothiadiazole described in U.S. Pat. No. 1,758,576, phenylmercaptotetrazole described in U.S. Pat. No. 2,403,927, etc.); mercaptopyrimidine described in U.S. Pat. No. 2,304,962; mercaptotriazine described in U.S. Pat. No. 2,476,536; mercaptotetrazaindene described in British Pat. No. 893,428; various mercapto compounds (e.g., thiosalicylic acid described in U.S. Pat. No. 2,377,375, thiobenzoic acid described in U.S. Pat. No. 3,226,231, sugar mercaptal described in Japanese Patent Publication No. 8,743/72, etc.); oxazolinethione described in U.S. Pat. No. 3,251,691; triazolothiadiazole described in Japanese Patent Publication No. 17,932/68; and the like can be added. Also, nitrogen-containing heterocyclic compounds having an anti-fogging action such as azaindene compounds (e.g., tetrazaindenes such as the compounds described in U.S. Pat. Nos. 2,444,605, 2,444,606, 2,450,397, Japanese Patent Publication Nos. 10,166/64, 10,516/67; pentazaindenes such as the compounds described in U.S. Pat. No. 2,713,541, Japanese Patent Publication No. 13,495/68), urazole compounds described in U.S. Pat. No. 2,708,161, etc., can be employed. Also, benzenesulfinic acid described in U.S. Pat. No. 2,394,198, benzenethiosulfonic acid, benzenesulfinic acid amide described in Japanese Patent Publication No. 4,136/68, sugar mercaptal described in Japanese Patent Publication No. 8,743/72, and the like can be added. Further, various chelating agents described in U.S. Pat. No. 2,691,588, British Pat. No. 623,488, Japanese Patent Publication Nos. 4,941/68 and 13,496/68 can be added for preventing fog due to metal ions.

The photographic emulsion layers or other hydrophilic colloidal layers in the light-sensitive material of the present invention can contain, for example, polyalkylene oxides described in U.S. Pat. No. 2,441,389, the ethers and amides of polyalkylene oxides described in U.S. Pat. No. 2,708,161, other polyalkylene oxide derivatives described in British Pat. No. 1,145,186, Japanese Patent Publication Nos. 10,989/70, 15,188/70, 43,435/71, 8,106/72 and 8,742/72, thioether compounds described in U.S. Pat. Nos. 3,046,132–3,046,135 or Japanese Patent Publication Nos. 9,019/70 and 11,119/72, thiomorpholines described in Japanese Patent Publication No. 28,325/72, quaternary ammonium compounds described in U.S. Pat. No. 3,772,021, pyrrolidines described in Japanese Patent Publication No. 27,037/70, urethane or urea derivatives described in Japanese Patent Publication No. 23,465/65, imidazole derivatives described in Japanese Patent Publication No. 45,541/72, polymers described in Japanese Patent Publication No. 26,471/70, 3-pyrazolidones described in Japanese Patent Publication No. 27,670/70, for the purpose of increasing the sensitivity, enhancing the contrast or accelerating the development.

To the photographic emulsions of the light-sensitive material of the present invention can be added inorganic or organic mercury compounds for sensitizing or antifogging purposes. For example, mercury complex salts described in U.S. Pat. No. 2,728,664, benzothiazole mercury salts described in U.S. Pat. No. 2,728,667, mercury salt adducts described in U.S. Pat. Nos. 2,728,663 and 2,732,302, organic mercury compounds described in U.S. Pat. Nos. 2,728,665 and 3,420,668 can be used.

Where the silver halide grain size is particularly small (less than about 0.4 $\mu$m or less than about 0.2 $\mu$m), the compounds described in, e.g., British Pat. Nos. 1,316,493, 1,317,138, 1,317,139, 1,317,709, 12,97,901 and West German Patent Application OLS No. 2,235,031 can be added as a sensitizing agent to the photographic emulsions of the light-sensitive material of the present invention.

The photographic emulsion layers in the light-sensitive material of the present invention can contain a conventionally used, non-diffusible, dye image-forming coupler. A dye image-forming coupler (herein abbreviated "color coupler" is a compound capable of forming a dye image by reaction, upon photographic development, with an oxidation product of an aromatic primary amine developing agent. The color couplers can be either a 4-equivalent type or a 2-equivalent type or, also, they can be colored couplers for color correction or couplers capable of releasing a development inhibitor. As a yellow-forming coupler, there can be usefully used open-chain ketomethylene type compounds such as acylaminoacetamide compounds, as a magenta-forming coupler, pyrazolone compounds or cyanoacetyl compounds and, as a cyan-forming coupler, naphtholic or phenolic compounds. Couplers can be introduced into the photographic emulsion layers using methods commonly employed for multi-color light-sensitive materials.

The present invention can also be applied to a multilayer photographic material comprising a support having thereon at least two light-sensitive layers having a different spectral sensitivity. Multi-layer color photographic materials usually comprise a support having thereon at least one red-sensitive silver halide emulsion layer, one green-sensitive silver halide emulsion layer and one blue-sensitive silver halide emulsion layer. The sequence of these layers can be optionally selected as required. Usually the red-sensitive silver halide emulsion layer is combined with a cyan-forming coupler, the green-sensitive silver halide emulsion layer with a magenta-forming coupler, and a blue-sensitive silver halide emulsion layer with a yellow-forming coupler, although different combinations can be used in certain cases.

The photographic emulsion layers and other hydrophilic colloidal layers in the light-sensitive material of the present invention can contain, individually or in combination, developing agents such as aromatic diols (e.g., hydroquinone, etc.), aminophenols, phenylenediamines, 3-pyrazolidones, ascorbic acid or derivatives thereof. The combination of hydroquinone and an N-hydroxyalkyl-substituted p-aminophenol derivative described in Japanese Patent Publication No. 43,814/73 is particularly advantageous. When the developing agents are water-insoluble, they can be added as a dispersion.

As a support, there can be used either transparent or opaque supports usually used for photographic elements such as glass plates comprising soda glass, potash glass, borosilicate glass, quartz glass, or like glass; films comprising synthetic high polymers of polyalkyl acrylates, polyalkyl methacrylates, polystyrene, polyvinyl chloride, partially formalated polyvinyl alcohol, polycarbonate, polyesters, (e.g., polyethylene terephthalate, etc.) or polyamides; films comprising cellulose derivatives (e.g., cellulose nitrate, cellulose acetate, cellulose acetate butyrate, etc.); paper; baryta-coated paper; $\alpha$-olefin polymer-coated paper; synthetic papers comprising polystyrene or the like; ceramics; metal; and the like.

The photographic emulsion layers and other layers of the light-sensitive material of the present invention can be coated according to various known coating methods. Suitable coating methods include a dip coating method, an air knife coating method, a roller coating method, a curtain coating method and an extrusion coating method. The method described in U. S. Pat. No. 2,681,294 is an advantageous method. Also, two or more layers can be coated at the same time using the method described in, e.g., U.S. Pat. Nos. 2,761,791 and 3,526,528.

The light-sensitive material of the present invention can contain an antistatic layer or an electrically conductive layer, e.g., a metal layer formed by vacuum evaporation or electrodeposition or an ionic polymer.

All known processes can be used for the photographic processing of the light-sensitive material of the present invention. Known solutions can be used as the processing solution with the processing temperatures being less than about 18° C, about 18° to about 50° C and higher than about 50° C.

To the light-sensitive material of the present invention can be applied any development processings for forming silver images (black-and-white photographic processing) and color photographic processings (development processing for forming a dye image).

In the case of subjecting the light-sensitive material of the present invention to a black-and-white photographic processing, the developer used can contain a known developing agent. As the developing agent, there can be used, individually or in combination, dihydroxybenzenes (e.g., hydroquinone, chlorohydroquinone, bromohydroquinone, 2,3-dichlorohydroquinone, methylhydroquinone, isopropylhydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-pyrazolines (e.g., 1-(p-hydroxyphenyl)-3-aminopyrazoline, 1-(p-methylaminophenyl)-3-aminopyrazoline, 1-(p-aminophenyl)-3-aminopyrazoline, 1-(p-amino-m-methylphenyl)-3-aminopyrazoline, etc.) and the like.

To the developer can be added, if desired, a preservative (e.g., sulfites, bisulfites, ascorbic acid, etc.), an alkali agent (e.g., hydroxides, carbonates, etc.), a pH buffer (e.g., carbonates, borates, borci acid, acetic acid, citric acid, alkanolamines, etc.), a dissolving aid (e.g., polyethlene glycols, the esters thereof, alkanolamines, etc.), a sensitizing agent (e.g., nonionic surface active agents containing a polyoxyethylene chain, quaternary ammonium compounds, etc.), a surface active agent, an antifogging agent (e.g., halides such as potassium bromide and sodium bromide, nitrobenzindazole, nitrobenzimidazole, benzotriazole, benzothiazole, tetrazoles, thiazoles, etc.), a chelating agent (e.g., ethylenediaminetetraacetic acid or the alkali metal salts thereof, nitrilotriacetate, polyphosphates, etc.), a development accelerator (e.g., the compounds described in U.S. Pat. No. 2,304,025 and Japanese Patent Publication No. 45,541/72, etc.), a hardener (e.g., glutaraldehyde, etc.), or an anti-foaming agent and the like.

A so-called "lith-type" development processing can be applied to the light-sensitive material of the present invention. Lith-type development processing means a development processing in which the development is conducted in an infectious manner under a low sulfite ion concentration using usually dihydroxybenzenes as a developing agent, for the photographic reproduction of line images or the photographic reproduction of half tone images through half tone dots. The details of such are described in Mason, *Photographic Processing Chemistry*,pp.163–165 (1966).

As a special type of development processing, a process of incorporating a developing agent in a light-sensitive material (for example, in an emulsion layer) and processing the light-sensitive material in an alkaline aqueous solution to effect development can be employed. This type of development processing is often utilized as one system of rapidly processing a light-sensitive material in combination with a silver salt-stabilizing processing using a thiocyanate or the like and, in the present invention too, such processing is possible.

As the fixing solution, a fixing solution of a generally used composition can be used. A fixing solution is generally an aqueous solution comprising a fixing agent, a hardener and other additives, the pH of the solution being usually about 3.8 to 5.0. Organic sulfur compounds, well known as fixing agents, capable of producing a soluble stable silver complex salt, as well as thiosulfates (e.g., sodium thiosulfate, potassium thiosulfate, ammonium thiosulfate, etc. ) and thiocyanates (e.g., sodium thiocyanate, potassium thiocyanate, ammonium thiocyanate, etc.) can be used as the fixing agent.

A water-soluble aluminum salt, functioning as a hardener, such as aluminum chloride, aluminum sulfate, potassium alum, etc. is generally added to the fixing solution.

The dye images are formed in a conventional manner. For example, the negative-positive process as described in the *Journal of the Society of Motion Picture and Television Engineers*, 61, pp.667–701(1953); a color reversal process comprising imagewise exposure, forming a negative silver image by developing with a developer containing a black-and-white developing agent, a uniform exposure (or other suitable fogging processing) at least one time, and subsequently conducting color development to form a dye positive image; a process using a direct positive emulsion to obtain a dye positive image; and the like can be employed.

A color developer generally comprises an alkaline aqueous solution containing a color developing agent. Examples of color developing agent include known primary aromatic amine developing agents, for example, phenylenediamines (e.g., N,N-diethyl-p-phenylenediamine, N-ethyl-N-(β-hydroxyethyl)amino-2-methylaniline, 4-(N-ethyl-N-β-methanesulfonamidoethyl)amino-2-methylaniline, N,N-diethylamino-2-ethoxyaniline, etc.), p-aminophenols (e.g., 4-aminophenol, 2,6-dichloro-4-aminophenol, 2-bromo-4-aminophenol, etc.), and the like. The color developer can further contain common additives such as alkali metal sulfites, carbonates, bisulfites, bromides, iodides, alkaline buffers, etc. Further, if desired, a dye-forming coupler, a competitive coupler, and anti-fogging agent, a hardener, an antioxidant, a thickening agent, and the like can be added.

According to the present invention, the photosensitive materials have a sufficient absorption density where a filter layer, an antihalation layer or a dyed hydrophilic colloid layer is provided, even though the thickness of such layer is very thin so as to maintain high resolving power. This is because the dye used in the present invention has high water solubility and good compatibility with gelatin. In the photosensitive materials of the present invention, the dyed layer is easily and irreversibly decolored in photographic processing and does not give rise to residual color on the photosensitive material after processing. Also, the processing solutions are not contaminated by coloration.

In the photosensitive materials of the present invention, the photographic properties of the photographic emulsion layer are not adversely affected because of the dye present in the hydrophilic colloid layer. Namely, the sensitivity or gradation of the photographic emulsion layer is not subjected to desensitization or a reduction in contrast except for the filter effect of the dyed layer itself (where the dyed layer is positioned nearer the incident light of exposure than the emulsion layer), and further the photographic emulsion layer is not fogged. This effect appears on both photographic properties in the intrinsic sensitization wavelength range of silver halide and properties in the color sensitization range. Further, these adverse influences do not appear with the lapse of time after preparation of the photosensitive material.

In the photosensitive materials of the present invention, only a basic polymer containing layer is dyed and the dye does not diffuse into other layers. Accordingly, no undesired deterioraton of sensitivity or gradation of the photographic emulsion layer occurs from an undesired spectral absorption effect due to diffusion of the dye and, consequently, photosensitive materials having good photographic properties, and particularly spectral properties, can be obtained. This is very advantageous in the case of black-white and color photographic sensitive materials having an antihalation layer between a photographic emulsion layer and the support of color photographic sensitive materials having three photographic emulsion layers and a filter layer which may function as an antihalation layer and is positioned between these emulsion layers.

Namely, if the dye diffuses from the layer to be dyed into an upper emulsion layer (farther from the support) or into a further upper hydrophilic colloid layer, the emulsion layer is affected by a filter effect of such dye resulting in a deterioration of sensitivity to light in the wavelength range absorbed by the dye and softening of gradation (i.e., a flatening of the characteristic curve).

On the contrary, in the photosensitive materials of the present invention, since such diffusion of the dye does not occur, deterioration of sensitivity of emulsion layers positioned above the dyed layer can be substantially disregarded, and the logarithmic exposure does not exceed 0.06.

The present invention is illustrated in greater detail in the following examples.

EXAMPLE 1

A solution containing gelatin and having the following composition was prepared.

| | |
|---|---|
| Gelatin | 40 g |
| Water | 600 cc |
| Poly(diethylaminoethyl methacrylate) (5% aqueous solution) | 60 cc |
| Dye (as described below) (1% aqueous solution) | 100 cc |
| Hardening Agent* (4% aqueous solution) | 200 cc |
| Phenoxy-polyoxyethylene-butane Sulfonic Acid (1% aqueous solution) | 40 cc |

*The hardening agent described in Example 1 of Japanese Patent Publication 17112/1968.

Dyes 1, 2, 4, 5, 6, 8, 9 and 12 described hereinbefore and Comparison Dyes A, B, C, D and E having the following formula were used as the dye in the above formulation.

Comparison Dye A

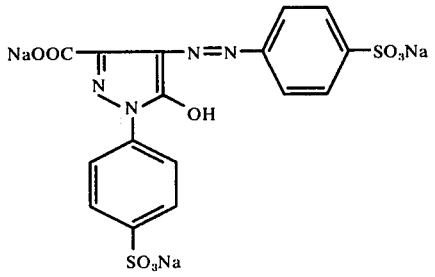

-continued

Comparison Dye B

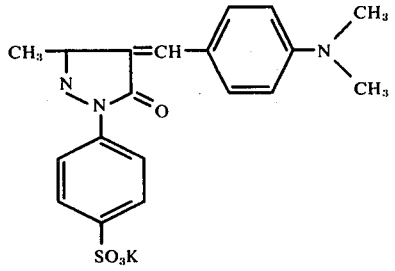

Comparison Dye C

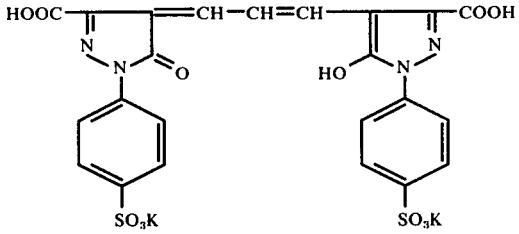

Comparison Dye D

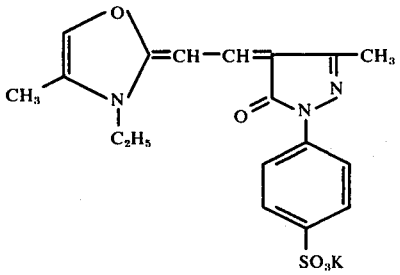

Comparison Dye E

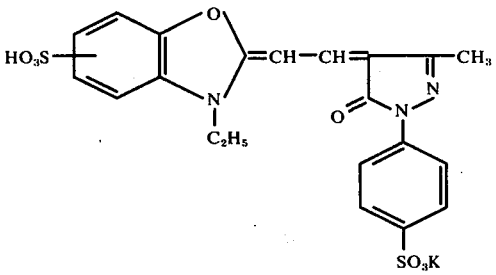

Each of the resulting solutions was applied to a cellulose acetate film in a dry thickness of 4 microns. Then, the spectral absorptions of each of the samples were determined.

Further, a solution having the following composition was applied in a dry thickness of 8 microns to the resulting layer of each sample. It was then dried for about 20 minutes to conclude the drying.

| | |
|---|---|
| Gelatin | 40 g |
| Water | 980 cc |
| Sodium Dodecylbenzene Sulfonate (1% aqueous solution) | 50 cc |

After removing the second layer which was applied without adding the dye from each sample by dipping in warm water at 50° C for 5 minutes while agitating, each sample was dried for 10 minutes. The spectral absorptions of each of these samples were determined also.

The optical density at the maximum absorption wavelength determined after application of the first layer is represented by $a_1$ and that determined after application and removal of the second layer is represented by $a_2$. The dye fixing ratio of the first layer is represented by $p = (a_2/a_1) \times 100$. The resulting values P for each sample are shown in the following Table 1.

Table 1

| Dye | Dye Fixing Ratio (P) |
|---|---|
| 1 | 84 |
| 2 | 90 |
| 4 | 87 |
| 5 | 92 |
| 6 | 94 |
| 8 | 85 |
| 9 | 93 |
| 12 | 80 |
| A* | 60 |
| B* | 25 |
| C* | 55 |
| D* | 0 |
| E* | 63 |

*For comparison

In the comparison samples using the known Comparison Dyes A to E, the ratio of the residual dye in the first layer is low, because the dyes diffuse into the second layer and are removed together with the second layer. On the contrary, in the samples of the present invention, the greater part of the dyes (above 80%) remains in the first layer without diffusing into the second layer.

EXAMPLE 2

Samples prepared by applying only the first layer containing the dye as described in Example 1 were processed at 20° C for 2 minutes using a solution having the following composition, and they were washed with water for 10 seconds and dried.

| | |
|---|---|
| N-Methyl-p-aminophenol Sulfate | 2 g |
| Sodium Sulfite | 100 g |
| Hydroquinone | 5 g |
| Borax | 2 g |
| Water to make | 1000 cc |

In the comparison sample using Dye A, a yellow coloration remained up to about a half of the initial density. The other samples were colorless and transparent.

EXAMPLE 3

To a cellulose acetate film having thereon a subbing layer, a silver iodobromide emulsion sensitized to red light containing a cyan color forming coupler was applied in a dry thickness of 5 μm. To this coated layer, a gelatin intermediate layer was applied in dry thickness of 1.5 μm and then a silve iodobromide emulsion layer sensitized to green light containing a magenta color forming coupler was applied in a dry thickness of 4 μm. This film was divided into five equal parts. To these films, coating solutions having the following five compositions were applied respectively to form a yellow filter layer having a dry thickness of 2 μm. (The absorption density of the yellow filter layer at the maximum absorption maximum wavelength was 0.9). Further, a blue-sensitive silver iodobromide emulsion containing a yellow color forming coupler was applied thereto in a dry thickness of 5 μm. Then, a surface protective layer composed of gelatin was applied in a dry thicknes of 1 μm. Thus color negative photosensitive material. Samples 3A to 3E were produced. The coating solutions for the yellow filter layer had the following composition.

3A

| | |
|---|---|
| Gelatin (8% aqueous solution) | 500 cc |
| Poly-(2-diethylaminoethyl-methacrylate) (5% aqueous solution) | 60 cc |
| Dye A in Example 1 (1% aqueous solution) | 120 cc |
| Na Salt of 2,4-Dichloro-6-hydroxy-1,3,5-triazine (1% aqueous solution) | 25 cc |
| Dodecaethylene Glycol-4-nonyl-phenol Ether (2% aqueous solution) | 30 cc |

3B

Dye E of Example 1 was used in 3A above instead of the Dye A. The amount of the solution (1% aqueous solution) added was 100 cc.

3C

Dye 2 hereinbefore described was used instead of Dye A in 3A above. The amount of the solution (1% aqueous solution) added was 50 cc.

3D

Dye 12 hereinbefore described was used instead of Dye A in 3A above. The amount of the solution (1% aqueous solution) added was 50 cc.

3E

| | |
|---|---|
| Gelatin (6% aqueous solution) containing a total of 8 g of Carey-Lea type yellow colloidal silver) | 500 g |
| Na Salt of 2,4-Dichloro-6-hydroxy-1,3,5-triazine (1% aqueous solution) | 25 cc |
| Polyethylene Glycol-4-nonyl-phenol Ether (2% aqueous solution) | 25 cc |

Each sample was exposed to light for 1/200 second through a Fuji color separation filter Sp-1 (the spectral percent transmission curve of which is shown in FIG. 1) and a continuous gray wedge using a tungsten light source of a color temperature of 5500° K and then each sample was processed as follows.

| Processing Step | Temperature | Time |
|---|---|---|
| 1. Color Development | 37.8° C | 3½ minutes |
| 2. Water Wash | " | 1 minute |
| 3. Bleaching | " | 4½ minutes |
| 4. Water Wash | " | 1 minute |
| 5. Fixation | " | 6 minutes |
| 6. Water Wash | " | 1 minute |
| 7. Stabilization | " | 1 minute |

The processing solution used had the following composition.

Color Developer

-continued

| | |
|---|---|
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Tetra-sodium Ethylenediamine Tetraacetate | 2 g |
| 4-Amino-3-methyl-N-ethyl-N-(β-hydroxyethyl)aniline Sesquisulfate (monohydrate) | 4 g |
| Water to make | 1 liter |
| Bleaching Solution | |
| Sodium Salt of Ethylenediamine Tetraacetate-Ferric Complex Salt | 100 g |
| Potassium Bromide | 50 g |
| Ammonium Nitrate | 50 g |
| Boric Acid | 5 g |
| Water to make | 1 liter |
| Fixing Solution | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 liter |
| Stabilizing Solution | |
| Boric Acid | 5 g |
| Sodium Citrate | 5 g |
| Sodium Metaborate (tetrahydrate) | 3 g |
| Potassium Alum | 15 g |
| Water to make | 1 liter |

The photographic characteristic curve of the yellow image of each processed sample was determined and the exposure necessary to obtain a fog density of 0.1 was determined from the characteristic curve. The value or the sensitivity is shown as a reciprocal of the exposure. The resulting relative values of sensitivity and the degree of stains of each sample obtained were as follows.

| Sample No. | Relative Speed of Yellow Image by Blue Light Exposure | Stain |
|---|---|---|
| 3A | 71 | None |
| 3B | 85 | None |
| 3C | 97 | None |
| 3D | 96 | None |
| 3E | 100 | Present |

In sample 3A wherein Comparison Dye Awas used, the sensitivity of the blue sensitive emulsion layer was quite inferior to that of the control Sample 3E because of a filter effect due to diffusion of the dye from the yellow filter layer into the blue sensitive emulsion layer. In Samples 3C and 3D according to the present invention, the sensitivity was substantially the same as that of the control Sample 3E wherein colloidal silver was used in the yellow filter layer, and further, no stain was observed.

While the invention has been described in detail and with reference to specific embodiments thereof, it will be apparent to one skilled in the art that various changes and modifications can be made therein without departing from the spirit and scope thereof.

What is claimed is:

1. A silver halide photographic sensitive element comprising a support having thereon at least one silver halide photosensitive emulsion layer and at least one hydrophilic colloid layer containing (1) a basic polymer which is a water-soluble high molecular weigth material containing basic groups in the main chain thereof or in a branched chain thereof and which is compatible with gelatin, said polymer being a polymer of an ethylenically unsaturated compound having a dialkylaminoalkyl ester group, a maleic acid anhydride copolymer or a derivative thereof, a polymer produced by reacting a polyvinylalkylketone with aminoguanidien, a polymer containing a 2-methylimidazole nucleus in a side chain thereof, and addition polymer of bisacrylamid and a secondary diamine or the quaternary salt thereof, or a copolymer including polyvinylpyridine or polyvinylquinoline, and (2) 80 to 800 mg per $m^2$ of said element of a merocyanine dye represented by the following formula (I):

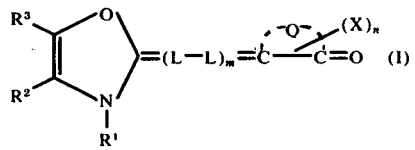

(I)

wherein $R^1$ represents an alkyl group having 1 to 20 carbon atoms, a substituted alkyl group having 1 to 20 carbon atoms and containing 1 or more of a halogen atom, a cyano group, a carboxy group, an alkoxycarbonyl group, a sulfo group, a sulfoalkoxy group, a phospho group, a carbamoyl group, an acyl group, an acyloxy group, a hydroxy group, an alkoxy group, an amino group, a mono- or bicyclic aryl group, a mono- or bicyclo heterocyclic group, a momo- or bicycle aryloxy group, a mono- or bicyclic aryloxy-carbonyl group, an alkenyl group, or an alkynyl group as substituents; each of $R^2$ and $R^3$ represents a mono-, bi-or tricyclic aryl group or a substituted mono, bi-or tricyclic aryl group substituted with 1 or more of an alkyl group, an alkoxy group, an alkylthio group, a halogen atom, a nitro group, a cyano group, a sulfo group, a phospho group, a carboxy group, an alkoxycarbonyl group, an amino group, an aralkyl group, a mono- or bicyclic aryl group, or a mono- or bicyclic aryloxy group as substituents; L represents a methine group; *m* represents an integer of 0, 1, 2 or 3; Q represents the group of atoms necessary to complete a ketomethylene group containing nucleus; X represents a carboxy group, a sulfo group, a phospho group or a group containing 1 or more of a carboxy group, a sulfor group or a phospho group as a substituent; *n* represents an integer of 1, 2 or 3 and wherein the total number of carboxyl groups, sulfo groups and phospho groups included $R^1$, $R^2$, $R^3$, L and X is at least 2 to 5, said basic polymer being present in an amount such that about 4 to 20 basic functional groups in the basic polymer are present per molecule of said dye, the placement of said at least one hydrophilic colloid layer containing said polymer and said dye being as follows:

A. Said support has thereon more than one hydrophilic colloid layer, and said silver halide photosensitive emulsion layer is a first hydrophilic collied layer which is located between said support and second hydrophilic collied layer which contains said basic polymer and said merocyanine dye, B. said support has thereon more than one hydrophilic colloid layer, and the hydrophilic colloik layer which contains said basic polymer and said merocyanine dye is located between said support and a hydrophilic colloid layer which contains said silver halide photosensitive emulsion, or C. said support has thereon more than one hydrophilic colloid layer, and the hydrophilic colloid layer which contains said basic polymer and said merocyanine dye is located between two hydrophilic colloid layers which each contain silver halide photosensitive emulsions.

2. The silver halide photographic element of claim 1, where in that at least one said hydrophilic colloid layer which containssaid basic polymer and said merocyanine dye is a filter layer.

3. The silver halide photographic element of claim 1, wherein the at least one said hydrophilic colloid layer which contains said basic polymer and said merocyanine dye is an entihalation layer.

4. The silver halide photographic sensitive element of claim 1, wherein $R^1$ is a sulfoalkyl group; $R^2$ and $R^3$ each is a phenyl group, Q is a pyrazoline-5-one nucleus, an isoxazolone nucleus or a barbituric acid nucleus; and X is a sulfoalkyl group, a sulfophenyl group, a dicarboxyphenyl group or a disulfophenyl group when *n* is 1 or X represents an sulfoalkyl group, a carboxyalkyl group, a sulfophenyl group or a carboxyphenyl groupwhen *n* is 2; and the total number of sulfo groups and carboxy groups present in said dye is 2 or 3.

5. The silver halide photographic sensitive element of claim 1, wherein $R^1$ represents an alkyl group; $R^2$ and $R^3$ each represents a sulfophenyl group; Q is a pyrazoline-5-one nucleus, an isoxazolone nucleus or a barbituric acid nucleus; X is a sulfoalkyl group, a sulfophenyl group, a dicarboxyphenyl group or a disulfophenyl group when *n* is 1 or X represents an sulfoalkyl group, a carboxyalkyl group, a sulfophenyl group or a carboxyphenyl group when *n* is 2; and the total number of sulfo groups and carboxy groups present in said dye is 1 or 3.

6. The silver halide photographic sensitive element of claim 1, wherein said merocyanine dye is

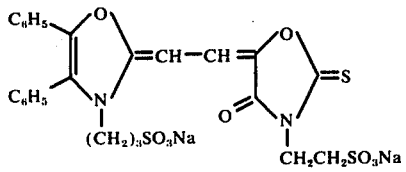

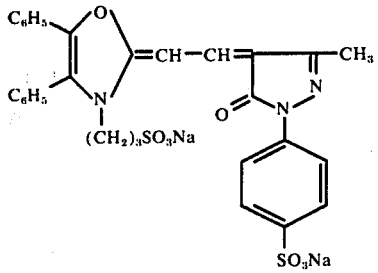

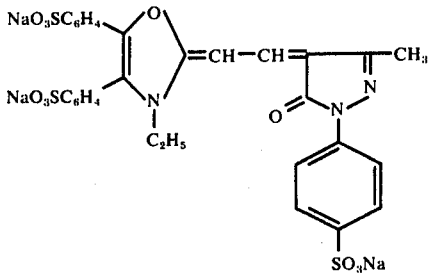

-continued

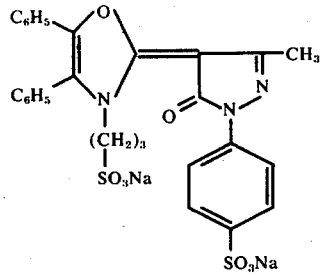

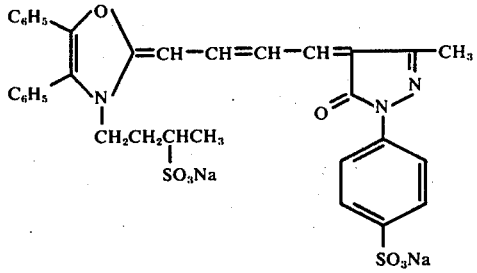

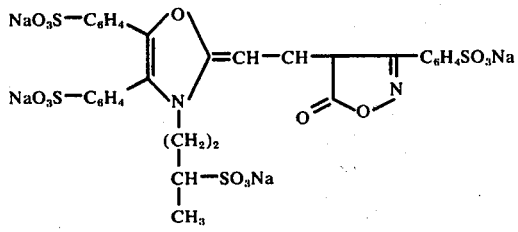

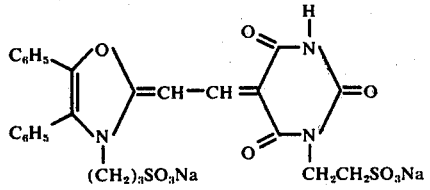

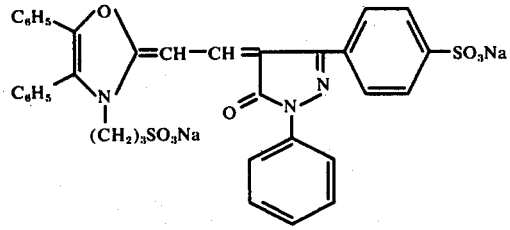

or

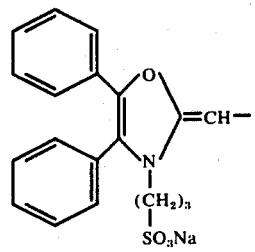

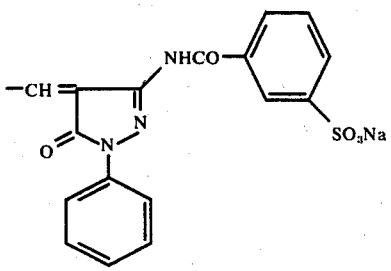

* * * * *